United States Patent [19]

Gertler et al.

[11] 4,227,479

[45] Oct. 14, 1980

[54] SUBMARINE COMMUNICATIONS SYSTEM

[75] Inventors: Morton Gertler, Silver Spring; Lester F. Whicker; Thomas Gibbons, both of Rockville, all of Md.

[73] Assignee: The United States of America as represented by the Secretary of the Navy, Washington, D.C.

[21] Appl. No.: 215,468

[22] Filed: Aug. 7, 1962

[51] Int. Cl.[3] ..... B63G 8/00; B63G 8/42

[52] U.S. Cl. ..... 114/312; 114/244; 114/253; 114/271

[58] Field of Search ..... 114/16, 16.05, 235, 114/235.2; 340/4, 4.5, 4 A, 3 T, 5; 178/6.8

[56] References Cited

U.S. PATENT DOCUMENTS

| | | | |
|---|---|---|---|
| 1,944,891 | 1/1934 | Hill | 343/709 |
| 2,418,846 | 4/1947 | Meacham | 367/104 |
| 2,433,971 | 1/1948 | Adams | 358/99 |
| 2,963,543 | 12/1960 | Link et al. | 358/99 |
| 3,005,973 | 10/1961 | Kietz | 114/244 X |
| 3,034,468 | 5/1962 | Aschinger | 114/245 |
| 3,034,471 | 5/1962 | Aschinger | 114/244 |
| 3,161,168 | 12/1964 | Rebikoff | 114/21 R |

*Primary Examiner*—David H. Brown

*Attorney, Agent, or Firm*—R. S. Sciascia; Q. E. Hodges

EXEMPLARY CLAIM

4. A towable sea-going vehicle for carrying communications equipment for use in conjunctive cooperation with communications equipment of another vessel comprising:

an essentially hollow body having openings in its walls for free flooding and self-bailing of said body;

said body having an essentially rounded, gently pointed nose section and a V-bottom portion, said V-bottom portion providing a surface for the planing of said body on the surface of water and providing a face portion for contributing to the hydrodynamic lifting of said body when in an underwater position;

buoyancy producing means located in said body to the extent that the weight of said body in air is substantially less than the excess buoyancy of said body when immersed in water;

and said body having an upper cambered portion for producing lift when said body is in an underwater position;

whereby said communications-carrying vehicle may be towed either submerged or on the water surface at speeds up to and in excess of 35 knots.

9 Claims, 7 Drawing Figures

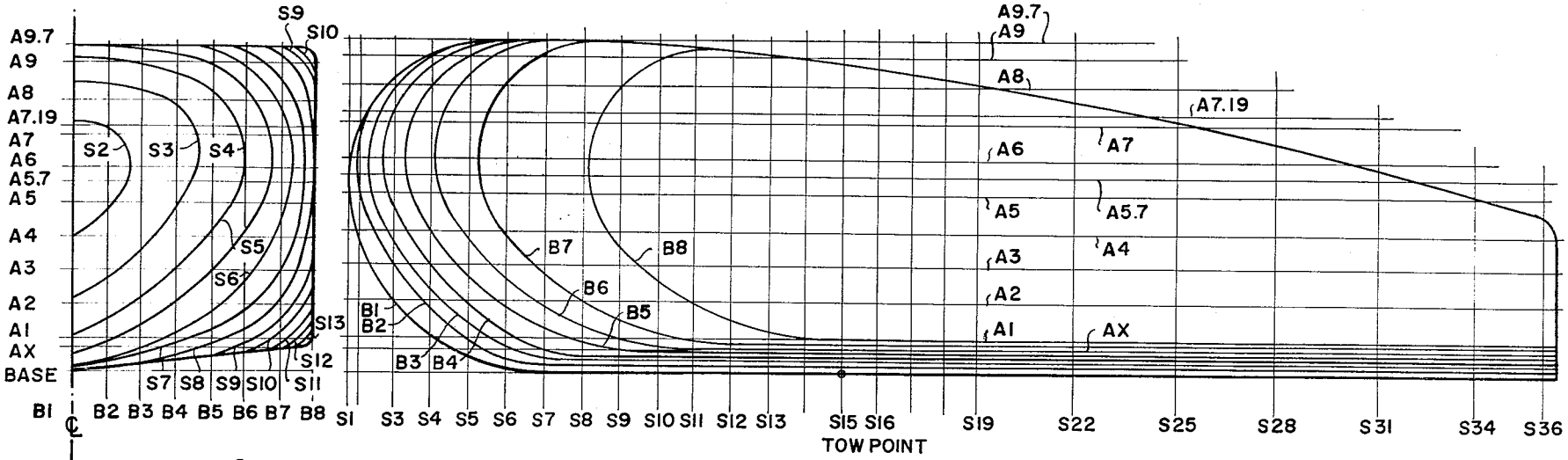
FIG. 4.
FIG. 5.
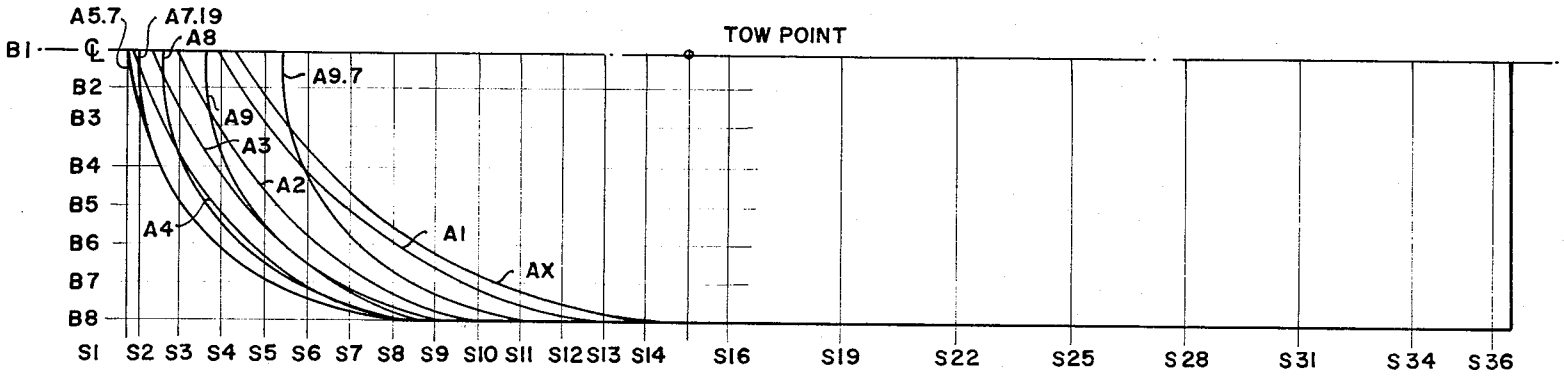
FIG. 6.

SUBMARINE COMMUNICATIONS SYSTEM

The invention described herein may be manufactured and used by or for the Government of the United States of America for governmental purposes without the payment of any royalties thereon or therefor.

This invention relates to a submarine communications system; and more particularly relates to a communications system wherein terminal transmitting and receiving communications equipment for a submarine is positioned distantly from and operated remotely from the position of the submarine.

In recent years the operational capabilities of submarines have geen greatly extended so that at the present time high speed submarines with great tactical and strategic destructive capabilities may operate at great depths for extended periods of time with very little likelihood of being detected. Indeed, the submarine as a weapon has been greatly expanded in its utility and effectiveness.

Yet, in present day operational high speed submarine types, there are certain structural appendages which detract from the potential operational maneuvering capabilities of a high speed (submersible) type submarine, notably a large bridge fairwater (sometimes referred to as a "conning tower") which is used primarily for housing communications such as visual sighting devices and radar and radio antennas and periscopes and secondarily to provide a high platform for boat maneuvering and lookout purposes.

It is well known, for example, that a bridge fairwater forms a large hydrofoil surface which causes rolling moments when the boat is put through a constant depth turning maneuver while submerged. These large rolling moments cause changes in depth which must be compensated for by positioning the diving planes at large trim angles. With a large bridge fairwater, tight turns at high speeds are difficult to make as well as other concurrent maneuvers requiring use of diving planes. The provision of more control surfaces to compensate for the hydrodynamic effects of a large bridge fairwater lowers the operating efficiency of the submarine.

While it may be true that a large, high bridge fairwater confers the advantage of permitting visual sighting through a periscope while the submarine is at somewhat lower depths than those permitted with a short fairwater the fact remains that if a submarine is operating at great depth and it is desired to obtain a visual sighting, the submarine must be brought all the way up to a position relatively quite close to the surface to obtain through a wake-producing periscope these visual sightings. This detracts from the overall aim of maintaining a posture of minimum detectability during operational situations.

Accordingly, it is among the objects of the present invention to provide means providing long range, short range, and visual communications capabilities for submarines while operating at depths below surface wave effects; to provide a visual and radio-type communications system for a submarine while operating at below periscope depth and at very high speeds; to provide an all-weather high speed surface and subsurface towing arrangement for carrying communications equipment as part of a submarine communication system; to provide a towable communications equipment-carrying vehicle capable of being towed at very high speeds over the surface of water or when submerged; to provide a towable vehicle adaptable for carrying a variety of communications equipment for cooperative use with a high speed towing submarine and of a hydrodynamic configuration resulting in very low drag when towed either on the surface of water and submerged, and to provide a highly efficient hydrodynamic towing system having minimum drag at high speeds both on the surface and submerged.

These and other objects, features and advantages of the present invention will be more completely understood by referring to the accompanying drawings in which like numerals indicate like parts, and in which:

FIGS. 4, 5 and 6 are contour views of the body of a towable vehicle according to the invention.

Figure 1:
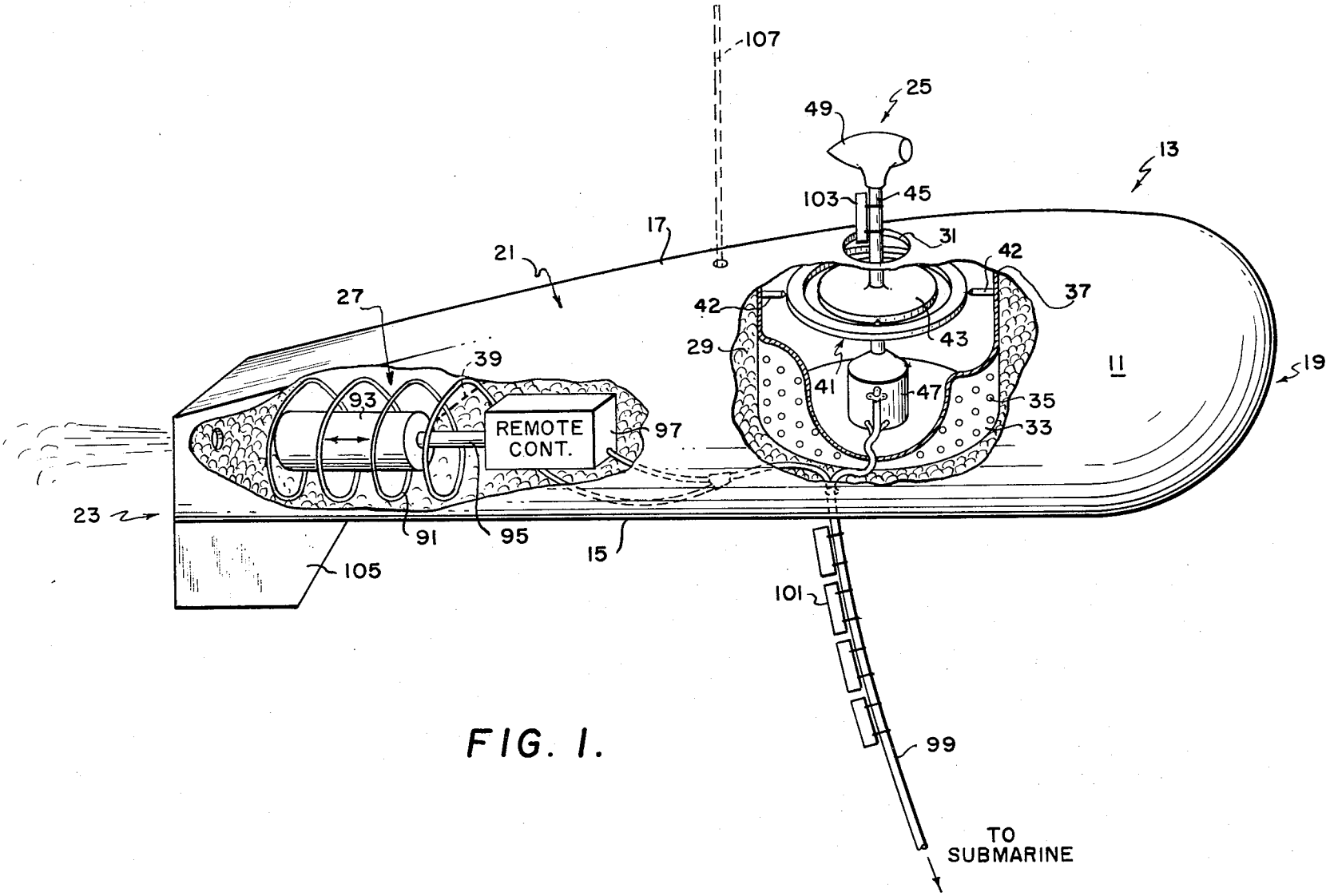
FIG. 1 is a cutaway view in perspective of a towable communications vehicle according to the invention.

Referring to the illustrated embodiment of FIG. 1, a self-bailing, towable, buoyant, freely floodable vehicle 11 for housing communications equipment for use and control by a towing submarine is shown in the form of rigid elongated streamlined hollow body 13 which may be made of any suitable sea water corrosion resistant material such as fiberglass, glass impregnated fiberglass, or any suitable metal such as aluminum. The vehicle 11 is small enough to be easily nested on or in a conventional submarine. The exact shape of the body 13 will be discussed in conjunction with FIGS. 4, 5, and 6, it being deemed sufficient at this point to state that the body 13 is a dual purpose towable vessel, the lower hull portion 15 of which is a V bottom, water-planing surface of small deadrise and the upper hull portion 17 of which is in the form of a hydrofoil or cambered surface having a nose section 19, a negative pressure-producing back region 21, and a fin-stabilized upright tail section 23. The overall dual purpose form of the body 13 permits the moving of the body either on the surface of water or submerged at high speeds with minimum drag and spray production.

The freely floodable interior of the body 13 is shown divided into two communications equipment sections—a forward section containing visual image-producing means such as a television camera unit 25 and an after section containing a VLF antenna unit 27. More or other different communications units may be provided if desired. The remainder of the interior of the body 13 is filled with buoyancy producing means such as glass, plastic or metal bubbles 29 as shown in FIG. 1, or any suitable buoyant material amenable to intimate contact with sea water and capable of retaining substantially constant buoyancy and volume despite exposure to high pressure at great sea depth. A self-bailing hole may be provided in the stern portion of the body 13.

Since each of the communications units 25 and 27 contain movable elements, it is necessary to partition these units from the remaining interior portion of the body 13 containing the buoyancy-producing glass or plastic bubbles to prevent said bubbles from interfering with the moving parts. In conjunction with the television camera unit 25, there is provided a circular opening 31 near the uppermost portion of the back region 21 through which water may pass to flood the interior of the body 13. A cylindrically shaped housing 33 having perforations 35 in its walls for passage of water and smaller than the diameter of each of the bubbles 29 is closed at its lower end and is fixedly mounted at its open upper end 37 to the body 13 so that open end 37 is in surrounding relationship to the body opening 31. For purposes of clarity in the illustrated embodiment of the invention shown in FIG. 1, only those perforations in walls of the housing 33 facing the reader are shown, it being understood that the entire wall area of the housing 33 may be perforated in order to permit efficient free flooding.

A generally box-shaped perforated housing 39 of construction similar to that of housing 33 for the low frequency unit 27 and for free passage of water is located in the after portion of the interior of the body 13.

The television camera unit 25 employs a two-axis gimbal mounting 41 having its fore and aft axial outer ring portions connected in any suitable manner to the wall of the housing 33, the ring portions in this particular instance being connected to the wall of housing 33 by pins 42. The inner pitch rotating portion of the gimbal mounting 41 is in the form of a disc member 43 connected at its transverse points to rotate within the outer gimbal ring. A non-rotating vertical hollow shaft 45 is mounted integrally with the disc 43 and extends upwardly therefrom through the opening 31 and downwardly therefrom into the hollow confines of the housing 33. An electric drive motor housing 47 which may be watertight for housing a "dry" motor, or freely floodable for housing a "wet" type motor, is rigidly mounted to the lower end of the hollow non-rotating shaft 45. At the uppermost end of the shaft 45 is mounted a television camera housing 49 of watertight construction and capable of withstanding high pressure differentials. The television camera unit 25 is thus a pendulum-mounted unit the lower end of which may swing freely in the uncongested interior of the housing 33 by virtue of said gimbal mounting.

Figure 2:
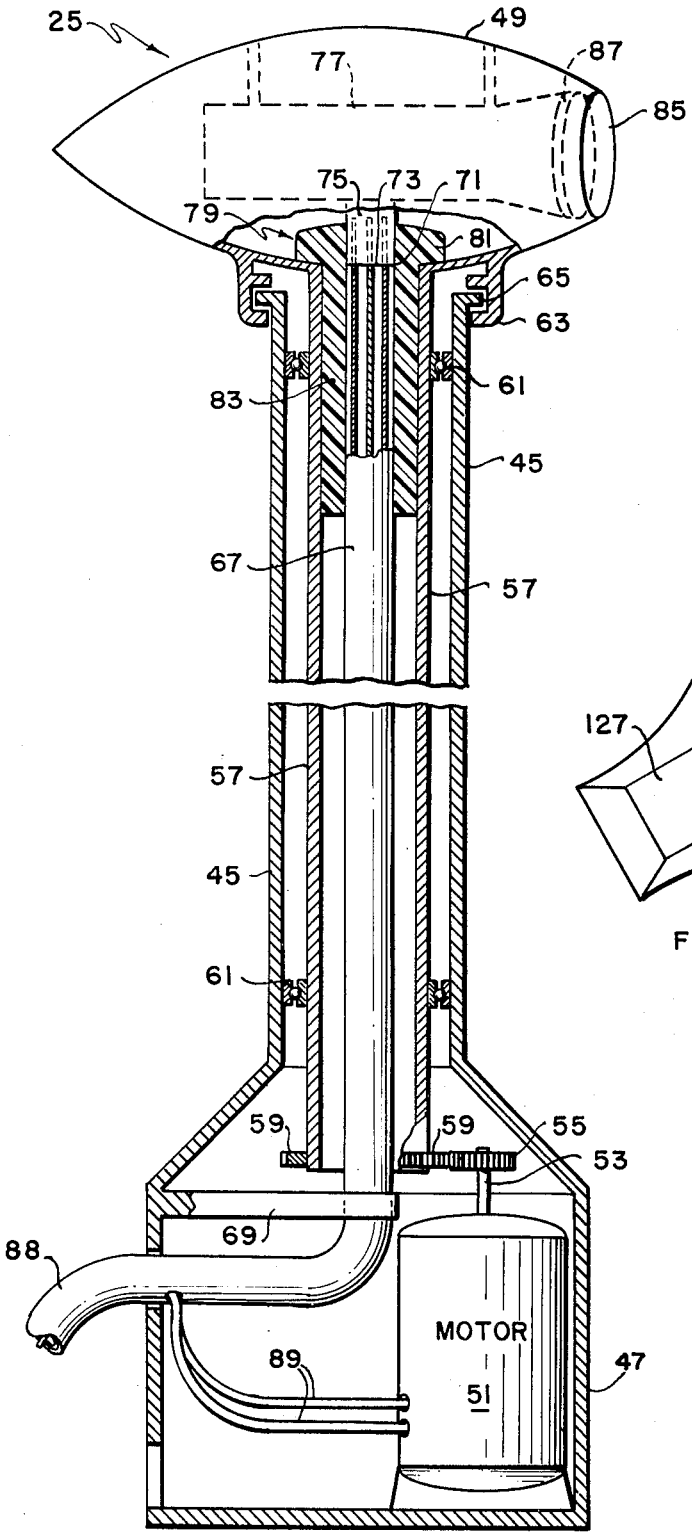
FIG. 2 is a view in cross section of an embodiment of a television camera unit according to the invention.

An embodiment of the television camera unit is illustrated in greater detail in FIG. 2, wherein a "wet" type electric drive motor is used to rotate the camera in azimuth. An electric motor 51 of the well known "wet" type is rigidly mounted in the motor housing 47, the drive shaft 53 of the motor 51 extending upwardly from the motor 51 and having a drive gear 55 mounted on the upper end thereof. A floating inner hollow shaft 57 having external gear teeth 59 at its lower end for engagement with the drive gear 55 is mounted to rotate within the outer non-rotating shaft 45 by means of bearings 61. The bearings 61 may also serve to provide some axial support for inner hollow shaft 57.

The inner hollow shaft 57 and the television camera housing 49 are bonded or welded together in any suitable manner to form a unitary integral rotating camera unit. This rotating unit is additionally supported by means of a peripherally channeled flange 63 integral with the camera housing 49 and bearing against a flange 65 at the uppermost end of the non-rotating hollow outer shaft 45.

A stiff, non-rotating coaxial cable section 67 for carrying camera drive signals and for providing a video signal output path in a conventional manner is rigidly mounted at its base portion to a rigid support member 69 suitably affixed in the interior of the motor housing 47. The coaxial section 67 extends upwardly through the hollow portion of the inner shaft 57 to a coaxial rotary coupling 71 which may be of any suitable well known construction. The line 73 indicates the location of the rotary coaxial coupling which connects the stiff non-rotating coaxial section 67 to a rotating stiff coaxial cable 75 suitably mounted to rotate with the camera housing 49. A camera such as a vidicon tube or any suitable small image orthicon tube is indicated by the dotted lines 77, and is mounted rigidly in the watertight housing 49 in any suitable manner.

Water may be prevented from entering the watertight camera housing 49 by any suitable sealing means. In the illustrated embodiment of FIG. 2, the sealing means used employs a hollow cylindrical plug 79 made of "Teflon" which, of course, has self-lubricating properties. The plug 79 has a large head 81, and a hollow cylindrical portion 83 which extends downwardly between the stiff coaxial cable section 67 and the inner hollow rotating shaft 57. The cylindrical portion 83 of the plug 79 is bonded or welded in any suitable manner to the inner hollow rotating shaft 57 and therefore rotates with the shaft 57. The hollow portion of the plug 79 is in intimate rotatable sliding contact with the outside insulated covering of stiff coaxial cable section 67. If desired, the insulated covering of the stiff coaxial cable section 67 may also be made of "Teflon" in order to reduce sliding friction.

The plug head 81 is suitably bonded or welded to the covering of the stiff rotating coaxial cable section 75 in the camera housing 49 and to the inside of the walls of the housing 49. Thus the plug 79 rotates with the camera housing 49 and the inner rotating shaft 57 and the rotating stiff coaxial cable section 75 located in the camera housing 49, and the plug 79 is in rotating sliding engagement with the stiff non-rotating coaxial cable section 67. Since the plug 79 at its head 81 is thus effectively integral with the camera housing 49 and the cable 75 as by bonding or welding, no water can possibly get into the camera housing 49, and in addition an effective seal is provided for the coaxial coupling at 71. If the drive motor is sufficiently powerful, the hollow cylindrical portion 83 of the plug 79 may be extended further down between the stiff non-rotating coaxial cable section 67 and the inner hollow rotating shaft 57 to provide an even stronger seal.

As previously mentioned, any suitable type of rotary coaxial coupling may be used. For example, the cable section 75 inside the housing 49 may be spring biased against the conducting elements of the stiff, non-rotating cable section 67 for sliding rotary contact. Or, an arrangement similar to that disclosed in U.S. Pat. Nos. 2,782,384 or 2,853,681 may be used. Also, the electrical circuit connections from the coaxial cable section 75 to the camera 77 rotating therewith are not shown, it being understood any suitable television camera circuitry may be used.

The camera housing 49 is provided at its front end with a window 85 of any suitable transparent material such as glass or clear plastic watertightly mounted in the housing 49 and capable of withstanding high pressure differentials. A lens 87 is mounted on the face of the camera 77 and may, of course, be of any desired focal length for producing any suitable image such as a wide angle or magnified image in the camera tube.

The stiff, non-rotating coaxial cable section 67 is, of course, sheathed in a watertight covering. A flexible watertightly sheathed coaxial cable section 88 integrally connected to the stiff section 67 is passed through the motor housing 47 to the remaining interior portion of the body 13. A pair of separate electrical leads 89 may be incorporated into the sheathing of the cable 87 for connection to the field coils of the drive motor 51.

Referring again to FIG. 1, the aforementioned very low frequency antenna unit 27 is located in the perforated boxlike housing 39 in the after portion of the interior of the body 13 and employs an antenna coil or helix 91, a tuning core element 93 mounted on a shaft 95 for reciprocating movement inside of the helix 91, and remote controlled servo motor 97 of any suitable construction for moving the core 93. One end of the helix 91 is connected to a watertightly sheathed conductor, and the remote controlled servo motor 95 has a pair of watertightly sheathed input conductors.

All of the electrical leads and cables from the units 25 and 27 are connected to, or may be incorporated in, a watertightly sheathed coaxial towing cable 99 which is securely fastened to the bottom of the body 13 in any suitable manner. The towing cable 99 is connected at its other end to any suitable winch means located on the towing submarine, and ultimately to suitable receivers and power sources located in the submarine.

The towing cable 99 is provided with a plurality of clip-on, swivel type rubber fairings 101 mounted thereon in the immediate vicinity of the point of attachment of the towing cable with the body 13. The fairings 101 prevent vibration of the cable 99 in the vicinity of the body 13 when the body is towed at high speeds. A fairing 103 of similar construction to the fairings 101 may be mounted on the non-rotating shaft 45 so that when the body 13 is towed submerged, turbulence behind the shaft 45 is eliminated. Alternatively, since the shaft 45 is non-rotating the shaft 45 itself may be faired to accomplish the same purpose.

The body 13 is of unique shape and has buoyancy characteristics particularly suited for producing minimum drag when towed submerged or on the surface of water. In terms of overall shape, the body 13 in its lower portion is a rather beamy planing hull (ratio of length overall to beam overall is about 2.5 to 1) having in its after ⅔ portion a V-bottom with a dead rise angle of about 6 or 7 degrees and parallel running lines. In the approximately ⅓ forefoot portion of the hull (which in the planing position is generally tossing or riding freely of the water) the deadrise increases towards the bow to an angle of approximately 25 or 30 degrees. In the forefoot portion, the shape of body 13 toward the bow is of sections of increasing deadrise, the forefoot aft of its prow being convex in order to achieve maximum smooth riding qualities with minimum impact, bow wave production, and spray. The upper portion of the body 13 is a hydrofoil shape which, when the body 13 is moved in a submerged position, produces lift.

The excess buoyancy of the vehicle 11 when fully loaded with its operational communications equipment is about twice the weight of the vehicle in dry air or less. Thus, for example, in one laboratory test model of about 48" overall length, 19" maximum beam and 13" maximum height, the weight of the vehicle in dry air was about 113 pounds, and the vehicle 11 had an excess buoyancy of about 200 pounds when submerged. This particular relationship was found to produce the optimum overall characteristics for the vehicle in all of its operating positions. The ratio of free-flooding volume to watertight volume may be from about 1:2 to about 1:4.

FIG. 4 shows the body 13 in front view with transverse contour sections taken along the station lines S1, S2, S3, etc. of FIGS. 5 and 6; and the lines B1, B2, B3, etc. indicate transversely stepped longitudinal vertical planes from which the longitudinal contour sections of FIG. 5 are taken; and the lines A1, Ax, A2, . . . A5, A5.7 etc. transverse horizontal planes from the horizontal contour sections of FIG. 6 are taken. Thus, station line S2 of FIG. 5 (or FIG. 6) cuts the transverse contour section indicated by the numeral S2 in FIG. 4; station line S3 of FIG. 5 cuts the transverse contour section indicated by the numeral S3 in FIG. 4; station line S5 of FIG. 5 cuts the transverse contour section indicated by the numeral S5 in FIG. 4, etc.

In a similar manner, in FIG. 5, the longitudinal contour section indicated by B1 is the stem of the body 13; B2 is the longitudinal contour section cut by the longitudinal vertical plane B2 of FIG. 4; B3 is the longitudinal contour section cut by the longitudinal vertical plane B3 of FIG. 4, etc. The outermost transversely stepped longitudinal vertical plane B8 is the upright flat side of the body 13.

In FIG. 6, the contour section A5.7 is cut by the longitudinally stepped horizontal plane A5.7 of FIGS. 4 or 5 and is the furthermost forward projection of the body 13.

From FIGS. 4, 5, and 6 the shape of the body 13 is seen to start at a somewhat blunted point at the intersection of the B1-A6 planes and a gently pointed prow extending therebelow to the keel. The hull shape in the forebody portion of body 13 aftwardly below the A6 plane, as exemplified by the contour sections S2, S3, etc. in FIG. 4, is generally in the form of slightly convex sections of decreasing deadrise aftward. The running lines of the body 13 as best seen in FIG. 5 are generally cissoids below the A5.7 plane except that aft of the station line S16, all of the running lines of the flattened V bottom are parallel. The sides of the body 13 are upright flat and without tumble home as indicated by the straight B8 contour section in FIG. 5.

Above the A5.7 plane, the shape of the body 13 is generally that of a hydrofoil having a rather abrupt camber in the nose section forward of station line S5 and then a gently downward-sloping camber aftwardly of station line S5. Speaking of the body 13 in hydrofoil terms, the bottom portion of the body 13, called the "face", is in the form of a V which is flat enough to produce a positive incremental pressure region when the body 13 is towed submerged at an attack angle of about 5 degrees up from the direction of forward motion of the body. The leading edge setback (the portion of the body 13 between the station lines S1 and S7 and below the plane A5.7) is a broad, convex frontal lift-producing area gently flowing aftwardly into the aforementioned flat V bottom "face" of the body 13.

The cambered back portion of the body 13 curves gently downward forming a negative differential pressure region and this curving portion is abruptly terminated at the upright, flat tail section 23 just aft of station line S36. The tail section 23 has no trailing edge setback as a hydrofoil. (The body 13 as planing hull may be said to have high "square" transom). Of course, due to the truncated, upright tail section 23 of the body 13, there is produced some turbulence when the body 13 is towed at high speed underwater. However, this turbulence has been found by laboratory experiment to be at acceptable lows at speeds up to and in excess of 35 knots. Moreover, when the body 13 is towed as a planing hull on the water surface, the high transom increases freeboard and minimizes surface drag and spray.

The tow point of the body 13 is indicated by legend in both FIGS. 5 and 6, and the location of this towpoint is very important for the proper operation of the vessel 11. The best point for the permanent location of the towpoint for both planing and submerged operating positions was found to be about 40% of the length of the body 13 as measured from the station line S1 aftwards—that is, at station 15 as shown in FIGS. 5 and 6. In a laboratory test model which was 48 inches long overall, the towpoint was thus positioned 19.2 inches aft of the extreme bow portion (station S1) of the body.

The choice of the aforementioned 40% location of the towpoint was based upon laboratory experiments wherein it was found that for surface towing, if the tow point was located forward of a point about 35% of the vessel length aft of the bow, the body 13 would plow into the water and not plane as desired; however, when in submerged towing conditions if the towpoint was located appreciably aft of the 40% point, the attack angle of the body 13 was increased to the extent that too much tension acting on a 0.20 inch diameter towing cable caused it to break.

The aforementioned location of the towpoint on the bottom of the body 13 determines to a considerable degree the angle of attack—that is, the angle measured upwardly (in the vertical plane) from the direction of forward motion of the body 13 when towed—of the body 13. In laboratory experiments in which the body was towed on the surface of water, a maximum ratio of the coefficient of lift to the coefficient of drag was found to occur at an attack angle of about 6 degrees. The value of said maximum ratio under this towing condition was about 0.14. When the body 13 was towed in a submerged position, the maximum ratio of the coefficient of lift to the coefficient of drag was found to occur at an attack angle of about 4 degrees and its value was also about 0.14. Thus, the unique shape of the body 13 according to the invention results in only a rather slight difference in angle of attack to produce the maximum ratio of the coefficient of lift to the coefficient of drag in the surface and submerged towing positions respectively. As a result of the tests, the selection of a towpoint for the body 13 at a point about 40% of its length as measured from the forwardmost point of said body resulted in an attack angle of about 5 degrees in both the surface and submerged towing positions. With the 5 degree angle of attack, the maximum ratio of 0.14 for the lift to drag coefficients is very closely approached. Thus, the selection of the aforementioned 40% towpoint is a very acceptable compromise as a permanent towing position.

Referring again to FIG. 1, the tail section 25 includes a pair of thin stabilizing fins 105 (only one fine shown) projecting downwardly from a flush junction with the flat sides of the body 13. In addition, a central longitudinal stabilizing fin may be incorporated into the tail section if still more directional stability is desired. Other suitable directional stabilizing fin arrangements may be used, of course, as long as they do not result in the creation of too much drag.

Other communications equipment may be installed in or on the vessel 11 such as, for example, low frequency whip antenna 107 (shown in phantom) mounted aft of the opening 31. (The tuner and local electrical connections for antenna 107 are not shown.) In laboratory experiments, a model of the body 13 was successfully towed at operational speeds without any deleterious drag effects caused by a three or four foot whip antenna in addition to the television camera unit 25.

Figure 7:
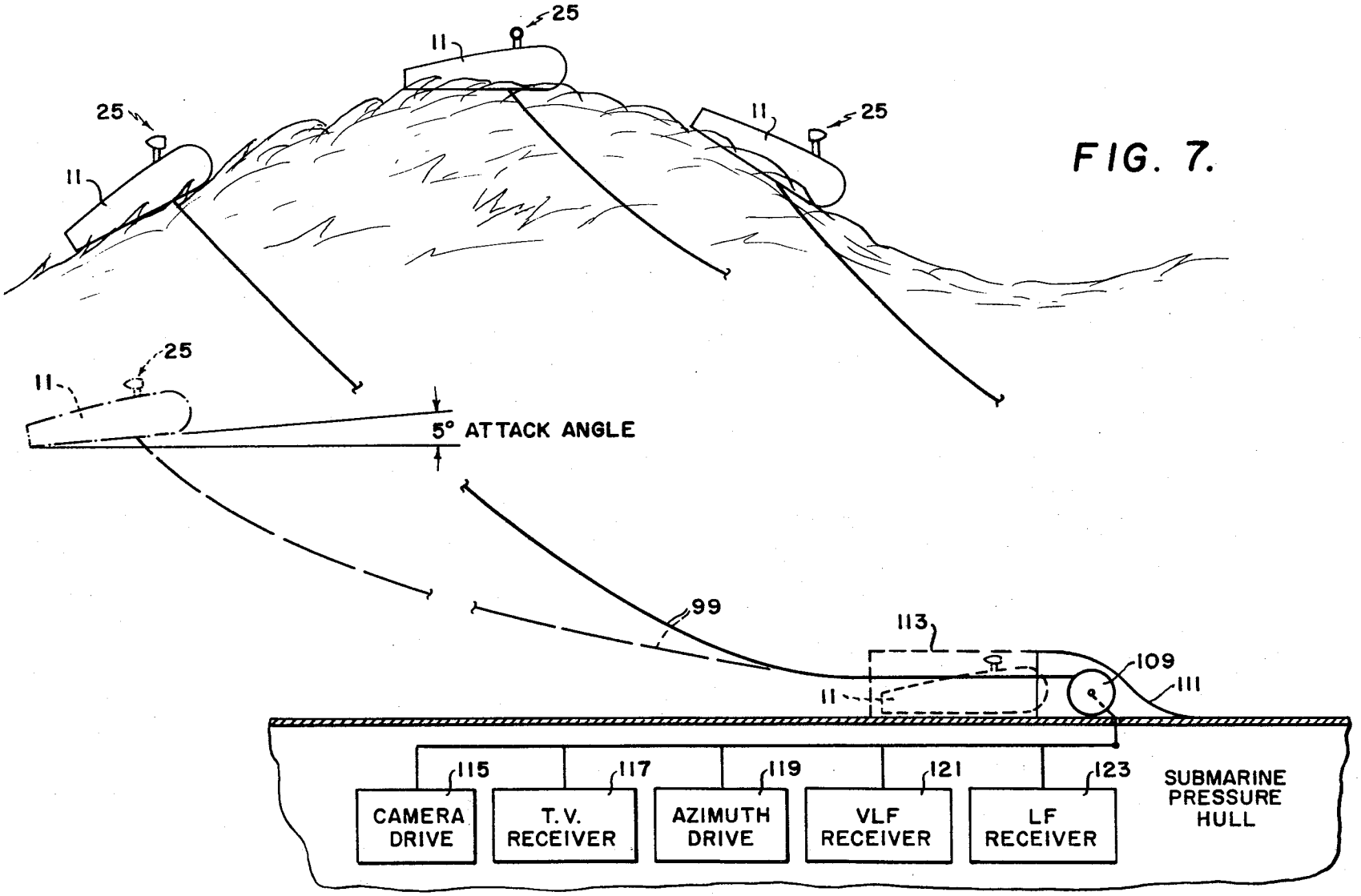
FIG. 7 is an illustrative view of the hydrodynamic system of the invention including towable vehicle operating positions in conjunction with a submarine.

Referring to FIG. 7, the towing cable 99 is shown passing around a winch 109 locatd in a small freely floodable, faired housing 111 located on the top of the submarine. The winch 109 may be driven by a motor of the "wet" type controlled in any suitable manner from inside the submarine. If desired, a repository which may be a simple recess or a socket indicated by the dotted lines 113 may be appended to the after end of the winch housing 111 for receiving the vehicle 11 when reeled in. However, this additional housing is not absolutely necessary because the vehicle 11, due to its minimal drag shape, may be reeled in to a position in relatively close proximity to the submerged submarine and towed in this position without any appreciable deleterious drag effects. However, for submarine surface operations, the added housing 113 provides a convenient repository for storage of the vehicle 11 so that it is not a navigational hazard. Where the submarine is a body of revolution enclosing a pressure hull, the winch and housing for the vehicle 11 may be located within the confines of the body of revolution, thus eliminating all appendages from the submarine body.

The end of the cable 99 passing through the winch 109 is watertightly passed through the pressure hull of the submarine in any suitable manner. The cable is then connected to suitable signal processing and power supplying communications equipment in the submarine. As shown by the blocks in FIG. 7, the communications equipment inside the submarine may include a camera drive unit 115, a video receiving unit 117, and a camera azimuth drive motor control unit 119—each of which may be of any suitable well-known construction. As many storage display tubes as desired may be used to display the received video in the submarine in a well known manner.

Also provided in the submarine for the communication equipment embodied in FIG. 1 is a suitable receiving unit 121 for the very low frequency antenna and a suitable LF receiver 123 for the whip antenna 107. It is emphasized that there is no particular limitation of the type or quantity of communications equipment which may be used in the system according to the invention as long as the equipment is suitable for transporation on or in the vehicle 11. For example, instead of the television camera and low frequency antenna units shown in the embodiment of FIG. 1, countermeasures, optical or infra-red equipment may be used, and the useful outputs therefrom suitably converted to electrical information signals in a well known manner. Moreover, if desired, active communications equipment such as active countermeasures, radar, sonar, magnetic detection or optical scanning devices may be located on or in the vessel 11. Of course, a single submarine may be provided with several towable vehicles 11, each having different communications equipment useful in various situations.

Figure 3:
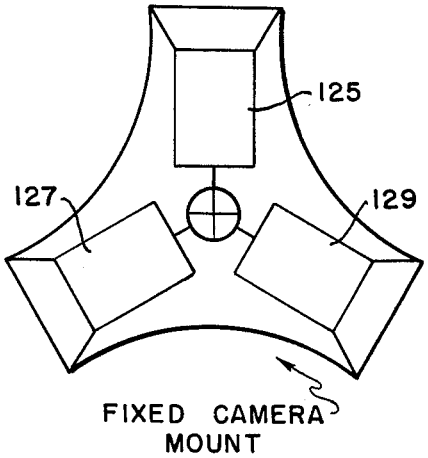
FIG. 3 is a diagrammatical view of another embodiment of a television camera unit.

Moreover, if desired, instead of using the rotating camera unit as shown in FIG. 1 to provide video information, a non-rotating multiple camera unit may be mounted in the same manner as unit 25 atop the vessel 11, each of the cameras providing output video signals representative of a sector viewed. As shown in the diagrammatic view of FIG. 3, three small television cameras 125, 127, and 129 are mounted on the gimbal 41 so that each respective camera encompasses a field of view of about 120 degrees. The video information output of each respective camera may then be multiplexed in any suitable manner, for example, as taught in U.S. Pat. No. 2,838,597, the information being received and "demultiplexed" in the submarine and fed to three separate display devices. Obviously, the advantage of using a multiplex system is that the entire 360 degrees of horizon may be visually scanned simultaneously thus eliminating the possibility of wave action causing the blocking of video information on certain bearings for even small periods of time. Another advantage of using the multiplex system is that the overall fidelity of the video is improved over that of a rather rapidly rotating single camera. In another arrangement, a rotating camera unit provided with wide angle lenses may be programmed for sector scanning, i.e. 360° back and forth scanning. In this type of arrangement, there need not be a rotary coaxial connection for the camera unit 25 because the coaxial cable may be twisted back and forth 360° or more without damage thereto.

According to the operating principles of the invention, when the vehicle 11 is towed on the surface of water, it planes along on the same course as the towing submarine in a wave-following manner as shown in FIG. 8. Under conditions where the waves from crest to crest are considerably longer than the overall length of the vehicle 11, very little pounding results. Since the length of the vehicle 11 may be as small as four feet, or smaller, and since the crest to crest distance of ocean waves is usually considerably greater than four feet, for all practical purposes, the vehicle 11 is planing in a surface wave-following manner most of the time. Naturally in sea conditions of short, choppy waves, the "ride" of the vessel 11 will be somewhat bumpier-especially when the crest to crest distance is approximately equal to the length of the vessel 11.

The vehicle 11 may be caused to submerged by taking in cable on the winch 109 or by the submarine's diving. The location of the cable tow point at 40% of the overall length of the vessel 11 aft of the bow results in the vessel 11 assuming an attack angle of about five degrees—resulting in a hydrodynamic towing system characteristically efficient to produce hydrofoil lifting action and surface planing without producing excess tension on the cable 99. Of course, the dimensions of the towing cable may be varied depending on the load to be placed thereon according to the speeds at which the vessel is to be towed and the displacement of the vessel 11. However, it is emphasized that it is advantageous that the vehicle 11 be as small as possible so that its repository 111 in the submarine need not be large.

In laboratory experiments with vehicle 11 of 48 inches length overall, 19 inches maximum beam, 13 inches maximum height, and a coaxial towing cable of 0.20 inches diameter, the vehicle 11 could be safely towed at about 500 feet depth at 5 knots; at about 275 feet at 10 knots; at about 200 feet at 15 knots; at about 150 feet at 25 knots, and at about 55 feet at 30 knots. Of course with heavier cable, both depths and speeds of operation may be increased. Using 500 feet of 0.20 inch diameter cable in the above experiments, the towline tension on the cable was about 1600 pounds at 32 knots, about 600 pounds at about 16 knots, and about 200 pounds at zero speed.

It will be further appreciated that the communications system according to the present invention implements the carrying out of tactical maneuvers highly advantageously and which cannot be carried out by utilization of any of the known systems or equipment of the prior art. For example, an attack submarine may carry out high speed offensive underwater operations while at the same time towing a communications vehicle according to the present invention in order to visually observe conditions at the surface. Thus, an attacking submarine may be apprised well in advance of the exact intentions of surface vessels while carrying out underwater operations—and without relying on the sometimes tenuous information received by sonar equipment. Of course, the visual image-producing means may also be used underwater.

Moreover, the friendly or inimical nature of surface ships may be quickly determined by the submarine without her needing to surface, thus revealing her own identity or perhaps creating a provoking appearance to ships in the area.

Of course, the communications system according to the present invention may be used in conjunction with conventional type submarines as an adjunct adding to their flexibility of operation. With a conventional submarine having a bridge fairwater, the repository for the communications vehicle 11 may be located at the base of, or just aft of, the fairwater.

Obviously many modifications and variations of the present invention are possible in the light of the above teachings. It is therefore to be understood that within the scope of the appended claims the invention may be practiced otherwise than as specifically described.

We claim:

1. An all-weather communication system for a high speed submarine operating below periscope depth and below depths at which surface wave action affects the motion of the submarine comprising:

a towable, freely floodable vehicle in the form of an essentially hollow body having a lower portion shaped for planing on the surface of water and an upper cambered portion for producing hydrodynamic lift;

radio wave antenna means located in said body;

visual image producing means pendulously mounted in said body for producing visual images of a region surrounding said body to the horizon;

buoyancy producing means located in said body;

said body when loaded with all of said means having a weight in air approximately equal to from about $\frac{1}{4}$ to about $\frac{1}{2}$ the excess buoyancy of said body when immersed in water;

electrically conducting towing cable means connected at one end to said radio wave receiving means and to said visual image producing means, and near said one end to said body at a point on the bottom thereof between 35% and 45% of the body's length as measured aftwise from the foremost portion of said body, whereby when said body is towed, the tension on said towing cable means in pounds is less than about 60 times the towing speed in knots;

and respective receiving means for said radio wave antenna means and said visual image producing means located in said submarine and connects to the other end of said electrically conducting towing cable means.

2. Apparatus according to claim 1 but further characterized by said towing means being connected to the bottom portion of said body at a point about 40% of its overall length as measured aftwise from its bow whereby said body when towed has an attack angle upward from the direction of the body's forward motion of about 5 degrees, at which attack angle the ratio of lift coefficient to drag coefficient is approximately a maximum.

3. A communications system for a submarine comprising:

a vehicle capable of being towed by the submarine at high speeds, said vehicle having a body shaped for planing on the surface of water and for producing lift when towed submerged;

said body in its foremost ⅓ portion having a nose section with a rounded point in approximately the center thereof;

a gently pointed water-cutting prow extending downwardly and aftwardly from said point to the bottom of said body;

a flattened V-bottom located in approximately to after ⅔ portion of said body and having a deadrise of less than 10 degrees;

said V-bottom having essentially parallel running lines;

said body having flat upright sides in said after ⅔ portion thereof and an upright transom in the stern portion thereof;

a smoothly rounded upper body portion extending upwardly and aftwardly from said gently rounded point to a maximum height at approximately ⅓ the overall length of said vehicle as measured aftwardly from said point, and then in a smoothly aftwardly descending curve to said transom and horizontally outwardly to sid flat upright sides;

electrically conducting towing cable means connected at one end to said body at the bottom thereof at a point approximately 40% of its length aft of said point and at its other end to a towing vessel;

communications means located in said vehicle and connected electrically to said towing cable means;

and further communications means located in said submarine and electrically connected to said other end of said towing cable means for cooperation with said first-mentioned communications means in said vehicle.

4. A towable sea-going vehicle for carrying communications equipment for use in conjunctive cooperation with communications equipment of another vessel comprising:

an essentially hollow body having openings in its walls for free flooding and self-bailing of said body;

said body having an essentially rounded, gently pointed nose section and a V-bottom portion, said V-bottom portion providing a surface for the planing of said body on the surface of water and providing a face portion for contributing to the hydrodynamic lifting of said body when in an underwater position;

buoyancy producing means located in said body to the extent that the weight of said body in air is substantially less than the excess buoyancy of said body when immersed in water;

and said body having an upper cambered portion for producing lift when said body is in an underwater position;

whereby said communications-carrying vehicle may be towed either submerged or on the water surface at speeds up to and in excess of 35 knots.

5. Apparatus as defined according to claim 4 but further comprising towing means connected to said body at a point on the bottom thereof approximately 40% of its overall length aft of its furthermost forward point, whereby when said body is towed on the surface of water or submerged, the tension in pounds on said towing means does not exceed about 60 times the towing speed in knots at all speeds below approximately 40 knots.

6. Apparatus as defined according to claim 4 but further characterized by said buoyancy-producing means being located in said body to the extent that the weight of said body in air is approximately ½ the excess buoyancy of said body when immersed in water.

7. Apparatus as defined according to claim 6 but further characterized by said buoyancy producing means comprising a plurality of discrete, hollow, rigid watertight bodies located inside said vehicle body.

8. An all-weather communications system for a submarine faciliating the reception by the submarine of visual and radio wave information without the necessity of the submarine's rising to a position near the surface at periscope depth or to a position on the surface of water comprising:

a vehicle for carrying communications equipment and capable of being towed at high speeds on or beneath the surface of water; and an electrically conducting towing cable means connecting said submarine and said towed vehicle for transmitting communication signals therebetween;

said towed vehicle being comprised of a body having an upper hull portion, a lower hull portion and directional stabilizing means carried by said lower hull portion in the aft region thereof;

said body terminating at the fore end thereof in a nose section and terminating at the aft and thereof in a truncated and essentially rectangularly outlined transom-like tail section;

said lower hull portion being shaped for planing on the surface of water and said upper hull portion being cambered for producing lift when said towed vehicle is submerged;

said lower hull portion having in its forebody a gently pointed water-cutting prow and transverse contour sections extending outwardly from said prow of slightly convex outline and decreasing deadrise to a station of said body approximately ⅓ aft of said prow;

the remaining ⅔'s after portion of said lower hull portion being comprised of a V-bottom with parallel running lines and having a deadrise angle of at least less than ten degrees;

said lower hull portion aft of said station approximately ⅓ aft of said prow having flat upright sides terminating in their aftermost extremities in said truncated transom-like tail section;

said towing cable means being connected to said V-bottom of said body at a point approximately 40% of the overall length of said body aft of said prow whereby when said vehicle is towed on the surface of water said body is capable of planing in a surface-wave-following manner with substantially negligible spray, bow-wave or wake production.

9. An all-weather communications system for a submarine facilitating the reception by the submarine of visual and radio wave information without the necessity of the submarine's rising to a position near the surface at periscope depth or to a position on the surface of water comprising:

a vehicle for carrying communications equipment and capable of being towed at high speeds on or beneath the surface of water; and an electrically conducting towing cable means connecting said submarine and said towed vehicle for transmitting communication signals therebetween;

said towed vehicle being comprised of a body having an upper hull portion, a lower hull portion and directional stabilizing means carried by said lower hull portion in the aft region thereof;

said body terminating at the fore end thereof in a nose section and terminating at the aft end thereof in a truncated and essentially rectangularly outlined transom-like tail section;

said lower hull portion being shaped for planing on the surface of water and said upper hull portion being cambered for producing lift when said towed vehicle is submerged;

said lower hull portion having in its fore body a gently pointed water-cutting prow and transverse contour sections extending aftwardly from said prow of slightly convex outline and decreasing deadrise to a station of said body approximately $\frac{1}{3}$ aft of said prow;

the remaining $\frac{2}{3}$'s after portion of said lower hull portion being comprised of a V-bottom with parallel running lines and having a deadrise angle of at least less than 10 degrees;

said lower hull portion aft of said station approximately $\frac{1}{3}$ aft of said prow having flat upright sides terminating in their aft most extremities in said truncated transom-like tail section;

said upper hull portion as viewed frontally terminating in a smooth point located approximately centrally of said nose section;

said upper hull portion having a shape aftwardly of said point defined by transverse contour sections of increasing height and area and of increasing horizontal flatness aftwardly to a maximum height at a transverse station located at approximately $\frac{1}{3}$ of said body's overall length as measured aftwardly from said smooth point;

said upper hull portion at its maximum height station being defined by a transverse contour section whose uppermost outline is essentially a straight line from side-to-side of said body;

said upper hull portion in the aftermost $\frac{2}{3}$'s portion of said body being defined by successively aftward transverse contour sections of straight-line uppermost outlines of essentially continuously decreasing height with the aftermost of said sections being an essentially rectangularly outlined upright transom;

said towing cable means being connected to said V-bottom of said body and a point approximately 40% of the overall length of said body aft of said prow;

whereby when said vehicle is towed on the surface of water said body is capable of planing in a surface-wave-following manner with substantially negligible spray, bow-wave or wake production and whereby when said vehicle is towed submerged in water said body is capable of producing hydrodynamic lift with said lower hull portion thereof acting hydrodynamically as a hydrofoil face.

* * * * *